US007137529B2

(12) United States Patent
Martinelli et al.

(10) Patent No.: US 7,137,529 B2
(45) Date of Patent: Nov. 21, 2006

(54) APPARATUS AND METHOD FOR DISTRIBUTING WARM PREPACKAGED FOODS

(76) Inventors: Mara Martinelli, Viale Repubblica, 9, Sassuolo (Modena) (IT) I-41049; Maria Cristina Martinelli, Viale Reiter, 44, Modena (IT) I-41100

( * ) Notice: Subject to any disclaimer, the term of this patent is extended or adjusted under 35 U.S.C. 154(b) by 165 days.

(21) Appl. No.: 10/477,311

(22) PCT Filed: May 8, 2002

(86) PCT No.: PCT/IB02/01543

§ 371 (c)(1),
(2), (4) Date: Nov. 10, 2003

(87) PCT Pub. No.: WO02/091317

PCT Pub. Date: Nov. 14, 2002

(65) Prior Publication Data

US 2004/0178213 A1 Sep. 16, 2004

(30) Foreign Application Priority Data

May 8, 2001 (IT) ..... MO2001A0085

(51) Int. Cl.
*G07F 11/14* (2006.01)

(52) U.S. Cl. ..... 221/150 R; 221/150 HC

(58) Field of Classification Search ..... 221/150 HC, 221/150 R, 120, 119; 99/326, 331, 407, 99/409, 334

See application file for complete search history.

(56) References Cited

U.S. PATENT DOCUMENTS 5,142,966 A * 9/1992 Morandi et al. ..... 99/352
5,168,795 A * 12/1992 Okada ..... 99/326
5,442,997 A * 8/1995 Branz et al. ..... 99/330
6,862,494 B1 * 3/2005 Hu et al. ..... 700/211

* cited by examiner

*Primary Examiner*—David H. Bollinger
(74) *Attorney, Agent, or Firm*—Jordan and Hamburg LLP

(57) ABSTRACT

An apparatus (1) for distributing pre-packaged, frozen or heated food products (12), comprises a magazine (7) for containing said products (12), resting means (11) for said products (12) in said magazine (7), moving means (10, 16, 17) for moving said products (12) inside said magazine, extraction means (20, 23) for extracting said products (12) from said magazine(7), said moving means comprise actuating means (16, 17) arranged outside said magazine (7). A method for dispensing pre-packaged, frozen or heated products from an apparatus (1) that automatically distributes said products, comprise picking up said products from a magazine (7) of said apparatus (1) and sending said products to a dispending zone (4) of said apparatus (1), the method further comprises identifying each product inside said magazine (7) and determining the position of said product inside said magazine (7).

37 Claims, 10 Drawing Sheets

APPARATUS AND METHOD FOR DISTRIBUTING WARM PREPACKAGED FOODS

This invention refers to an apparatus and a method for distributing pre-packaged frozen or heated foods.

Prior-art machines are known for the distribution of pre-packaged foods that comprise a refrigerated magazine designed to contain the foods to be distributed, which foods are normally pre-packaged in sealed containers in the form of a round or parallelepiped tray and are kept at constant temperatures by a refrigerating cell for frozen products. The magazine normally consists of a series of elements supporting said containers arranged regularly on several different levels around a central column, which can be actuated by suitable motor drive means.

The elements supporting each container consist of a pair of jointed shelves, which can move between a first position, in which they support a container resting on them and a second position, in which they release the container. The pairs of shelves can also move along pairs of vertical uprights to bring the containers resting on them from a magazine position to a position for extraction from the magazine.

The above machines can be fitted with an oven, for example a microwave oven, to heat the foods packaged in said containers before sending them to a dispenser area, from which they can be picked up by a user.

The above machines are fitted with electronic devices for managing the dispensing of said packaged products and managing their heating in the oven, where requested.

The prior-art machines have various disadvantages. Above all, the low temperatures of the product magazine may adversely affect both the operation of the mechanical parts that ensure product handling inside said magazine and the operation of the electrical and electronic apparatuses that control the actuation of said mechanical parts.

In addition, the product support means having the shape of jointed shelves may be subject to jams, which immobilise them in positions that prevent the handling of the products within the magazine, their transfer to the oven for heating and/or their transfer to an opening dispensing said products to the consumer.

Furthermore, in the prior-art distributors it is not possible to automatically identify any expired products and prevent them from being dispensed.

Another disadvantage of the prior-art distributors is that they require the products to be inserted into the magazine in a preset order. Any departure from said order inevitably causes products to be supplied that are different from those selected by the consumer.

The aim of this invention is to provide an apparatus and a method for dispensing pre-packaged foods that do not have the disadvantages mentioned above.

According to a first aspect of this invention, a device for distributing pre-packaged, frozen or heated foods is provided, comprising a magazine for containing said products, actuating means for moving said products inside said magazine, extraction means for extracting said products from said magazine, control means for controlling said actuating means and said extraction means, characterised in that, said actuating means, said extraction means and said control means are arranged outside said magazine.

According to another aspect of this invention, a method is provided for dispensing frozen or heated products from an apparatus that automatically distributes said products, comprising picking up said products from a magazine of said apparatus and sending said products to a dispensing area of said apparatus, characterised in that, said method further comprises identifying each product inside said magazine, determining the position of said product inside said magazine, determining the condition of said product.

According to a further aspect of this invention, a microwave oven is provided that can be associated with an apparatus for distributing pre-packaged products, said oven comprising microwave generating means, means for conveying said microwaves to a chamber inside said oven, characterised in that, it further comprises distributor means suitable for uniformly distributing said microwaves inside said chamber.

Owing to the invention, it is possible to avoid the risk that the low temperatures inside the magazine of the apparatus, in which the products for distribution are stored, adversely affect the operation of the mechanical and/or electronic devices of the apparatus.

Furthermore, the possibility of identifying each product and its position inside the magazine makes it possible to insert the products inside the magazine without following a preset order, thereby significantly saving time during product insertion operations. Finally, the possibility of determining the status of each product, in particular the possibility of identifying its expiry date, or checking whether the product has been stored correctly, if it has been provided with means for testing its state of conservation, completely eliminates the risk that a product may be dispensed to the consumer in a state which does not comply with legal regulations governing the sale of food products.

Further features and advantages of this invention will be apparent from the following description, which is made by way of example and without limiting the scope of the invention, and which refers to the accompanying drawings, wherein.

Figure 1:
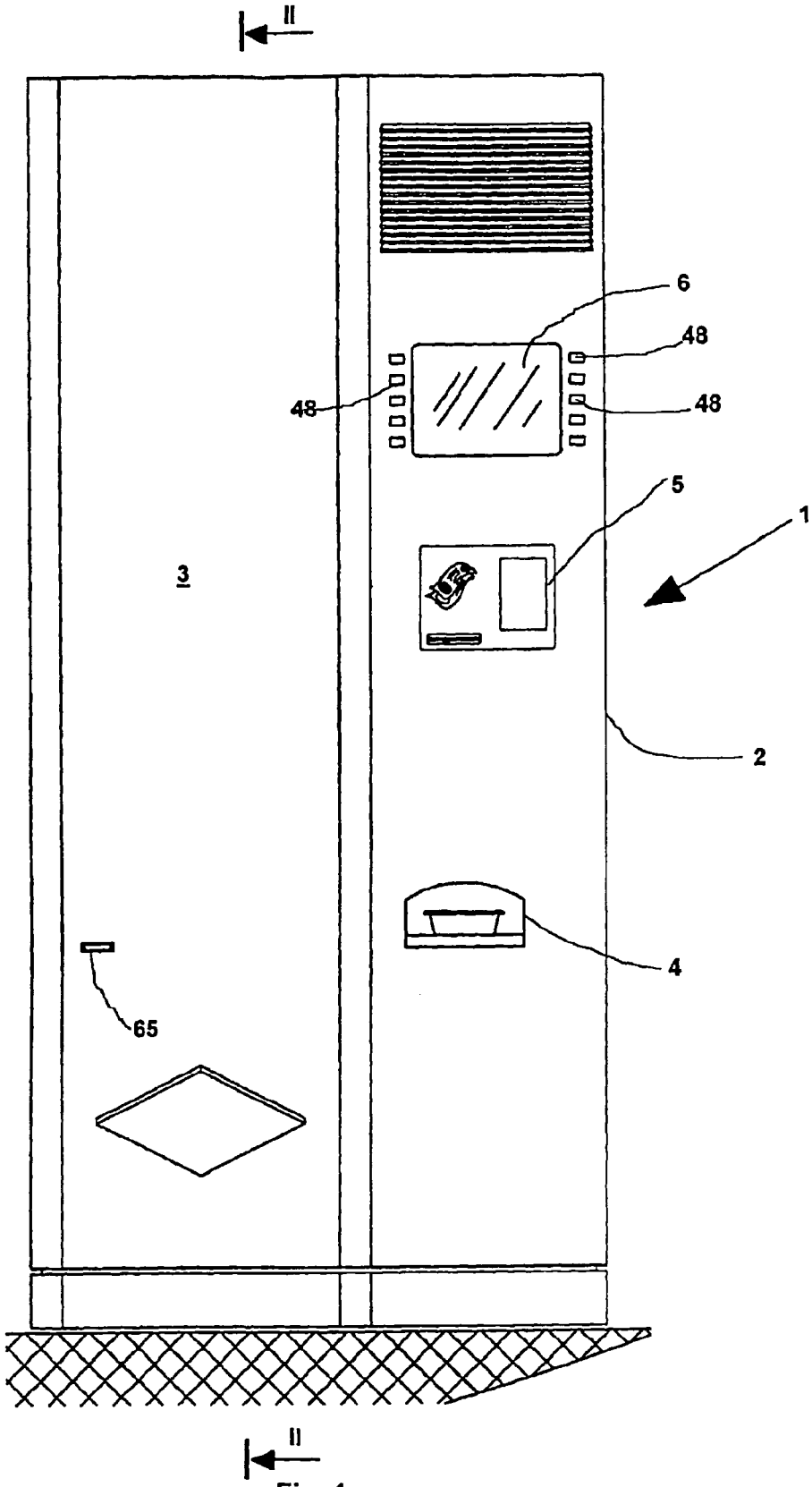
FIG. 1 is a front view of an apparatus according to the invention.
Figure 2:
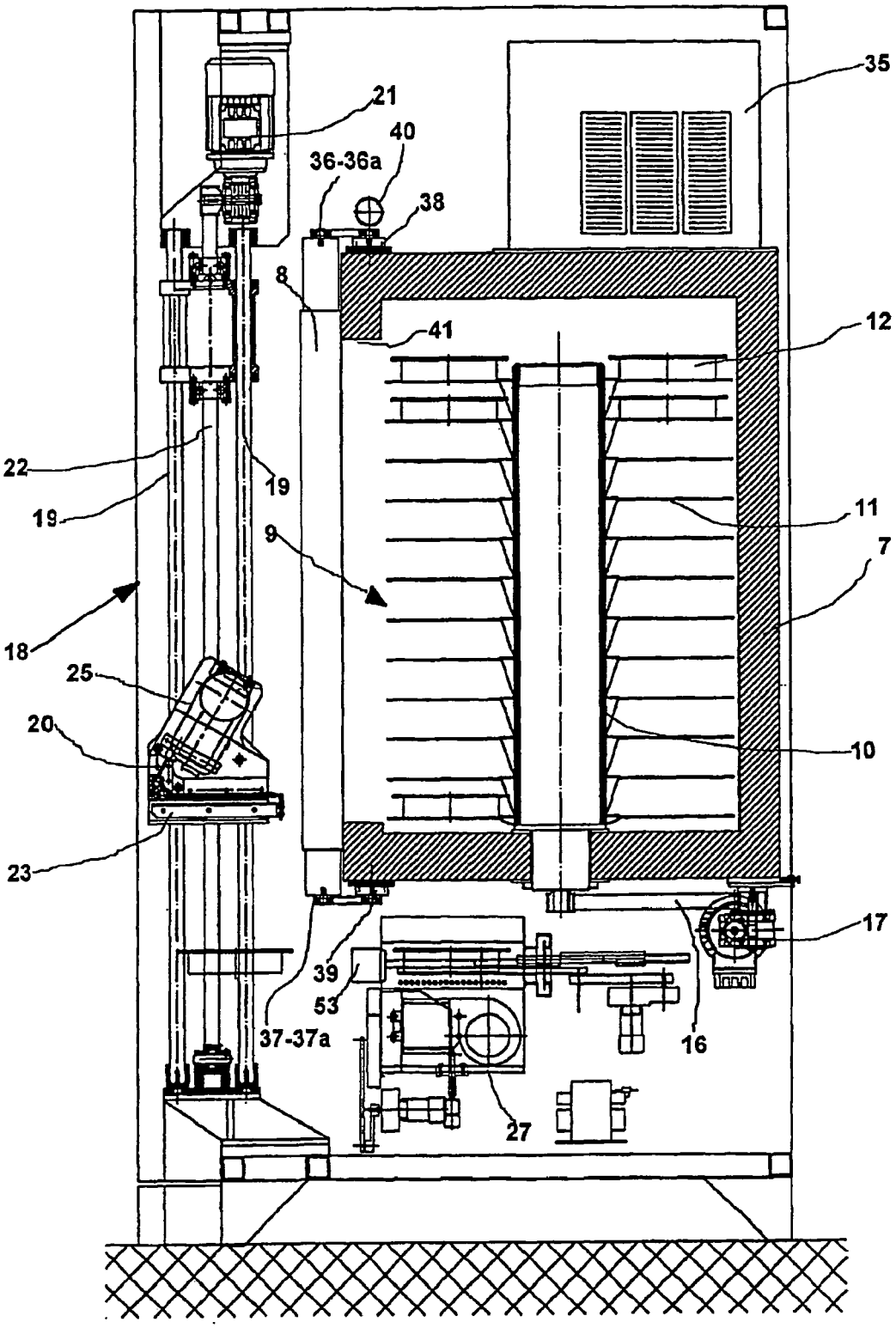
FIG. 2 is the section II—II of FIG. 1.
Figure 3:
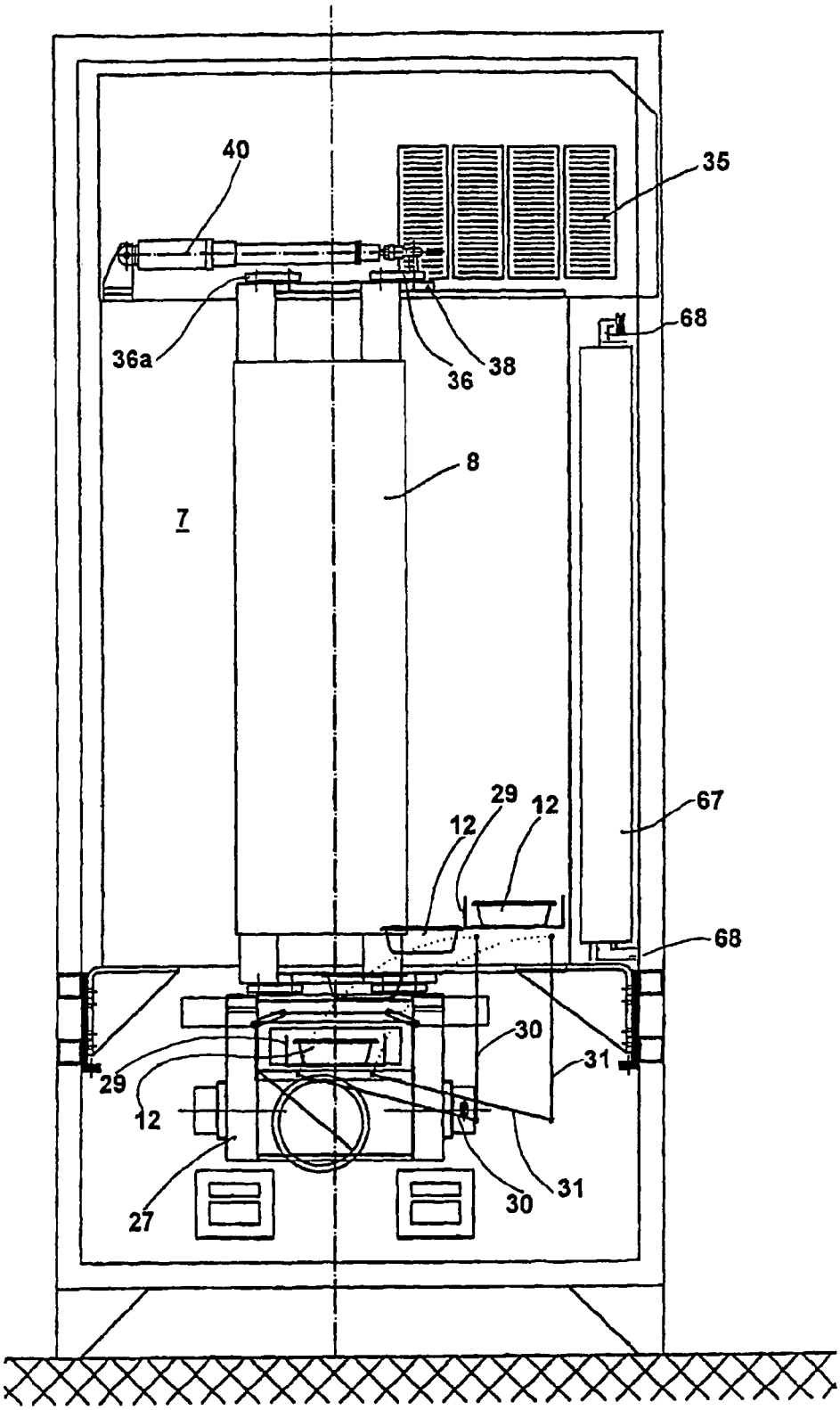
FIG. 3 is a view from the left of FIG. 2.
Figure 4:
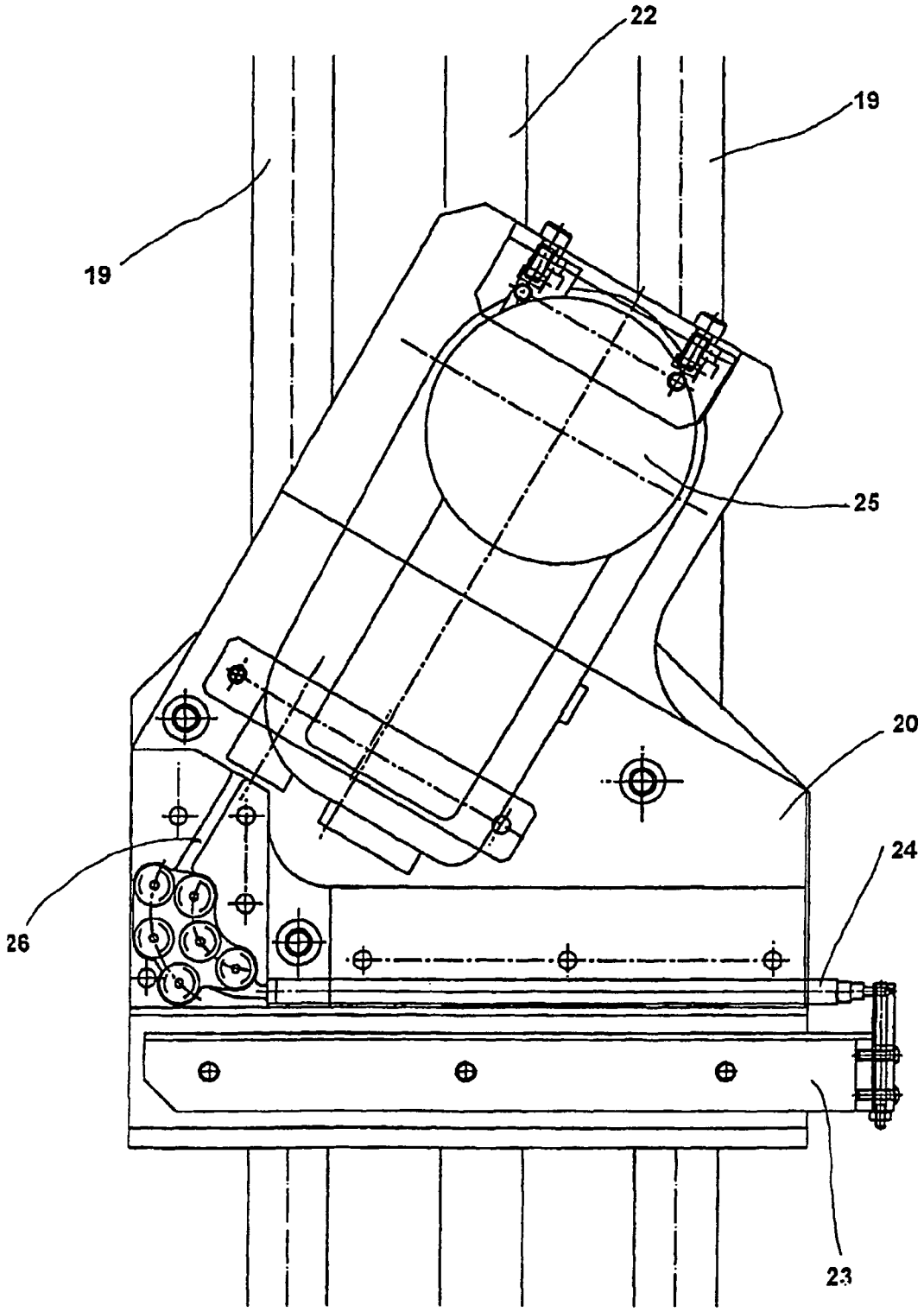
FIG. 4 is an enlarged detail of FIG. 2.
Figure 5:
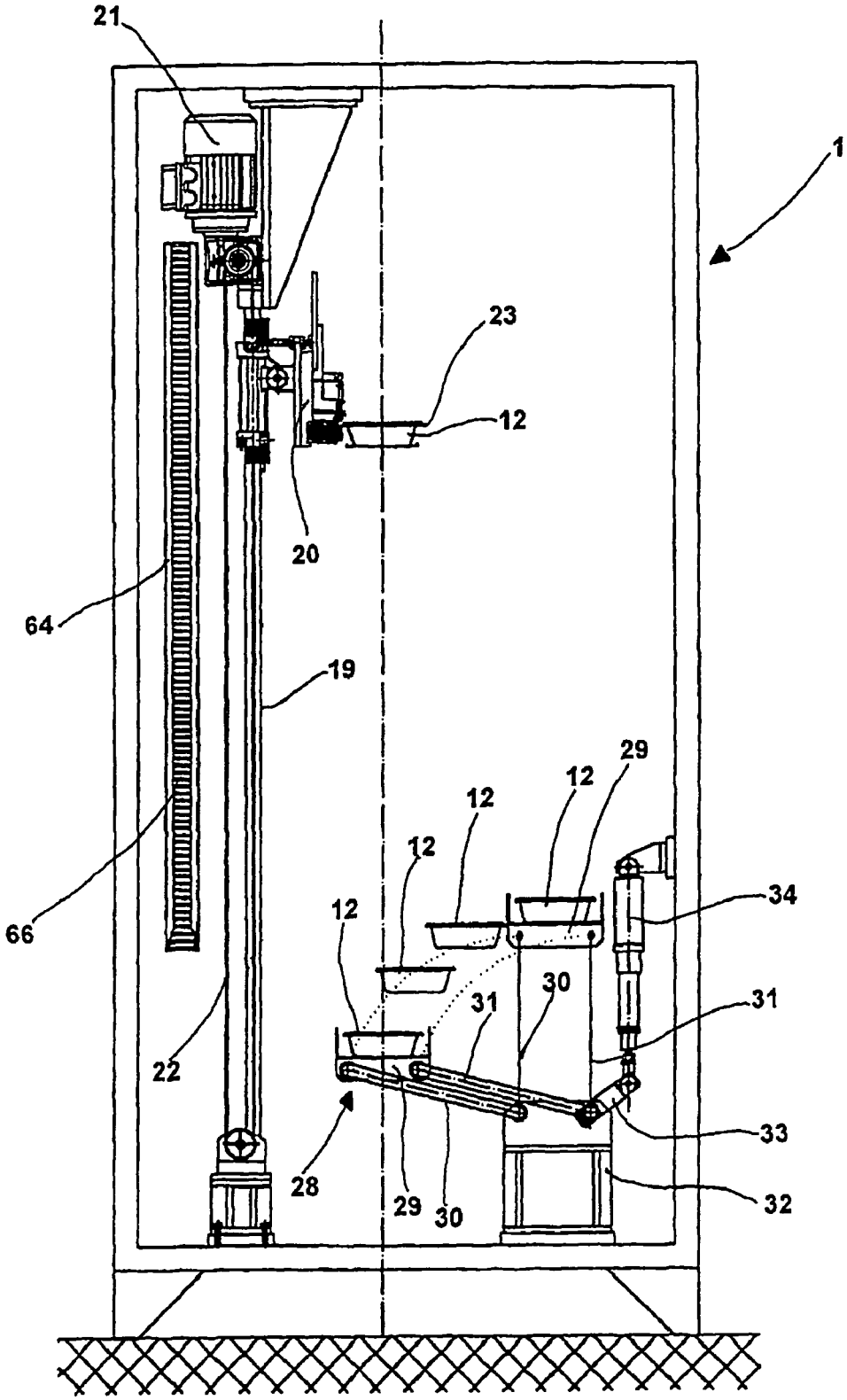
FIG. 5 shows the mechanisms for moving the product packages inside the apparatus according to the invention.
Figure 6:
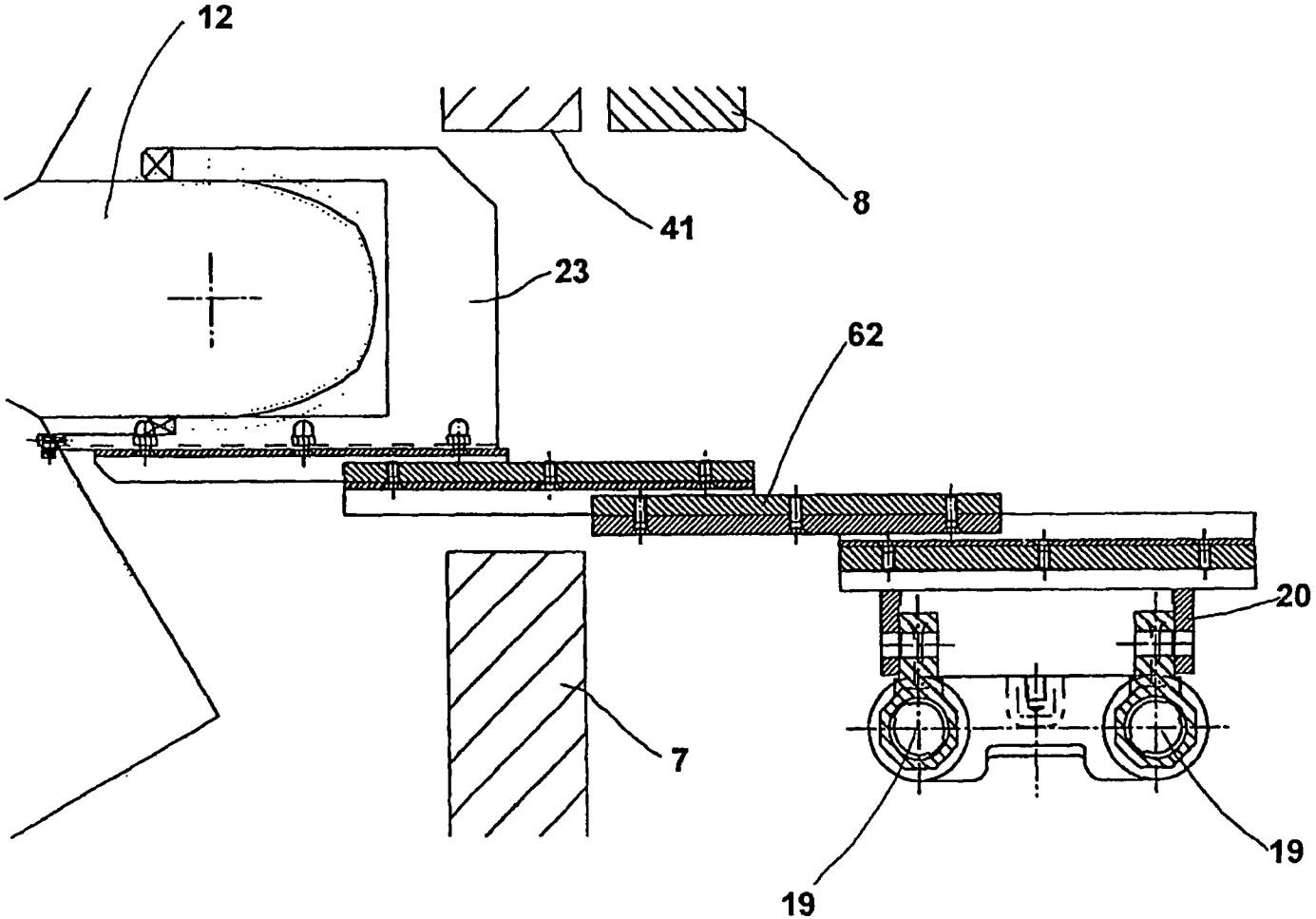
FIG. 6 is an enlarged detail of FIG. 5.
Figure 7:
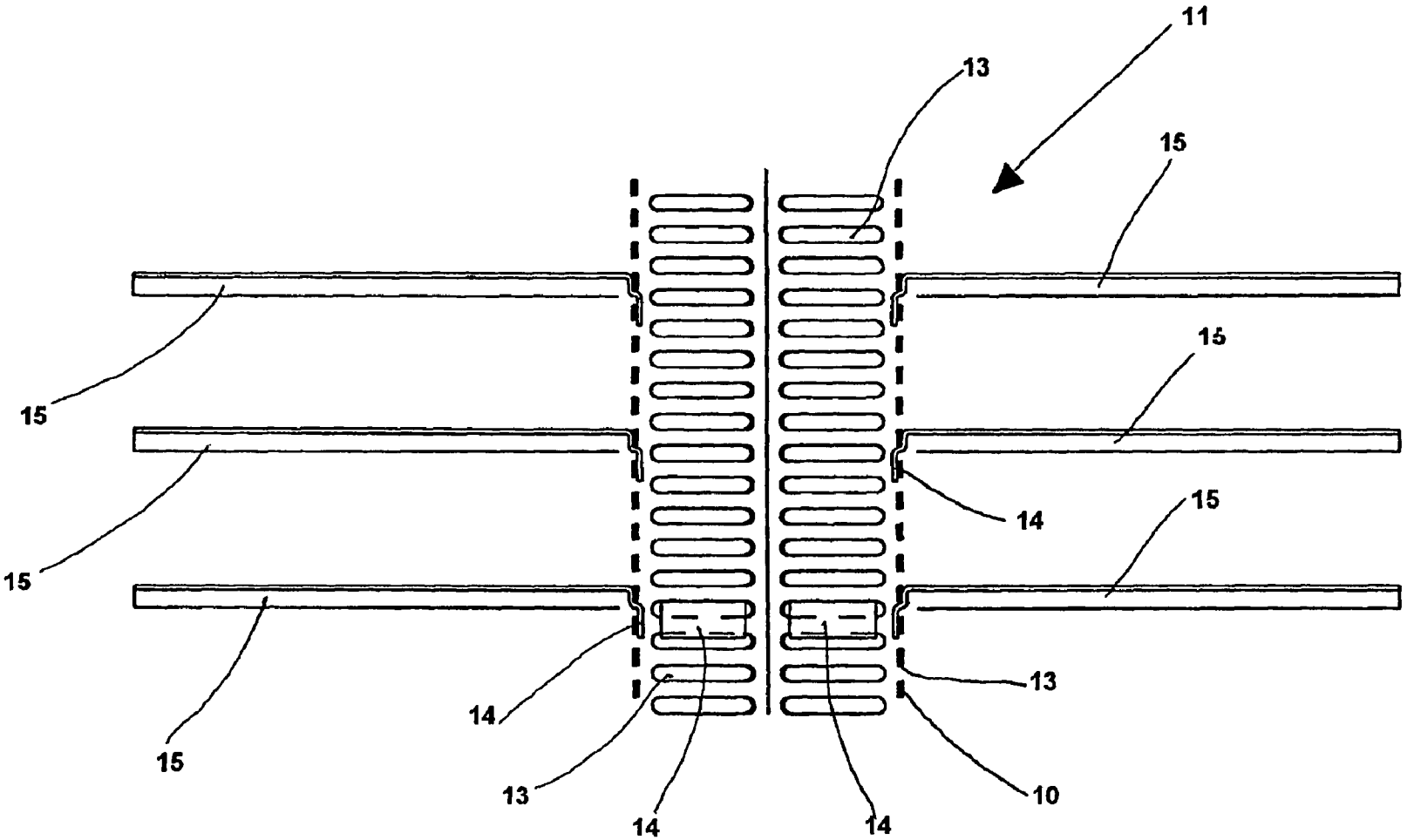
FIG. 7 is an enlarged detail of the product magazine of the apparatus according to the invention.
Figure 8:
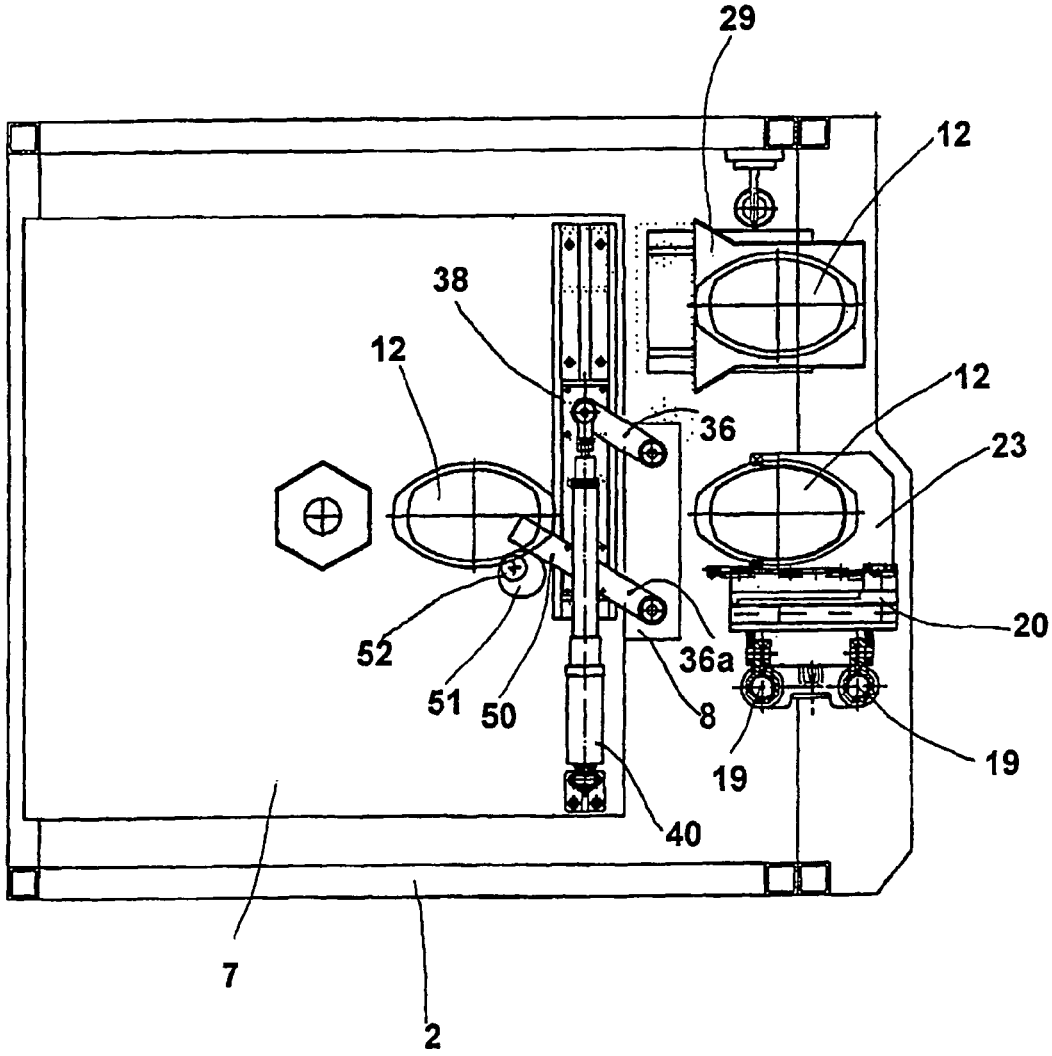
FIG. 8 is a view from above of the actuating means for actuating the door of the product magazine of the apparatus according to the invention.

FIG. 1 shows an apparatus 1 according to the invention for the distribution of pre-packaged foods, comprising a containing structure 2 having substantially the form of a cupboard, that is provided with a door 3 by means of which it is possible to access the inside of the apparatus 1. The apparatus 1 further comprises an opening 4 for dispensing said foods, pre-payment means 5 by means of which a user inserts bank notes and/or coins or magnetic cards inside the apparatus 1 to pay for the product that he wishes to pick up. Display means 6 are provided which display the available products with the relative prices, said display means 6 being associated with pushbutton means 48, by means of which the user can select the product or products that he wishes to purchase.

Within the containing structure 2 a magazine 7 is arranged for said food products, which magazine 7 is refrigerated by refrigeration means 35, arranged outside the magazine 7. The refrigeration means 35 are so chosen as to maintain inside the magazine 7 a temperature suitable for the conservation of frozen products.

The magazine 7 is provided with a sliding door 8 suitable for ensuring sealed closure of the magazine. On the top edge of the door 8 a first end of a pair of top levers 36, 36*a* is hinged whereas on the bottom edge of the door 8 a first end of a pair of bottom levers 37, 37*a* is hinged. The top lever 36 and the corresponding bottom lever 37 have their respective second end hinged to respective slide means 38 and 39 which are slidable, on the top face and on the bottom face of the magazine 7, in a direction that is parallel to the front face of the magazine 7. The second top lever 36*a* and the second bottom lever 37*a* are hinged, at an intermediate point of theirs, to the respective slide means 38 and 39 and extend beyond said intermediate point in a lever arm 50. A respective eccentric 51 is fixed to the top and bottom face of the magazine 7, which eccentric 51 may be oriented on a vertical axis 52. The position of each eccentric 51 is selected in such a way that the lever arm 50 of the lever 36*a*, or 37*a* respectively comes into contact with the eccentric 51 during movement of the respective slide 38, 39. This causes rotation of the levers 36*a* and 37*a*, which both causes the door 8 to slide in a direction that is parallel to the front face of the magazine 7 and to be distanced from said front face so as to completely disclose the space 41 giving access to the magazine 7.

At least one of the two slides 38, 39, for example the top slide 38, is actuated to slide by means of a respective operating cylinder 40, to cause the door 8 to open and close. The levers 36*a* and 37*a* are further associated with elastic contrast means which, when the slides 38 and 39 move in the opposite direction to the previous direction, to close the door 8, turn the levers 36*a* and 37*a* in the opposite direction to the previous direction, bringing the door 8 back into contact with the front wall of the magazine 7, in the closing position of the space 41. The pressure with which the door 8 is pushed against the front wall of the magazine 7 in a closed position can be adjusted by adjusting the position of the eccentrics 51 in relation to the axis 52.

The face of the door 8 that faces the magazine 7 is provided with seal means that are suitable for ensuring that when the door 8 is in the closed position no heat is lost from inside the magazine 7 via the edges of the door 8. Said seal means are heated to prevent their "sticking" to the opening edges 41 because of the formation of ice on said edges.

Inside the magazine 7 support means 9 for supporting the food products are provided, said support means 9 comprising a central column 10 around which resting means 11 are arranged for said food products, contained in suitable packages 12. The resting means 11 may consist of a plurality of superimposed annular resting surfaces, fixed at preset heights to the central column 10. More advantageously, the resting means 11 can comprise a plurality of shelves 15 having substantially the shape of a annular sector, that can be fixed in a movable manner, at one of their ends 14, to the central column 10. The central column 10 in this case may be provided with a plurality of vertical rows of slits 13, in each of which the said end 14 of a shelf 15 may be fixed. The use of the movable shelves 15 has the advantage that food-product containers of differing heights can be arranged inside the magazine 7, if the fixing position of the shelves 15 is properly selected, without being restricted to a fixed height for said shelves, which would limit the variety of types of container that could be stored in the magazine 7.

The central column 10 of the support means 9 is connected at one end, for example at its bottom end, to actuating means 16, actuated by drive means 17, suitable for rotating the central column 10 around its longitudinal axis.

The actuating means 16 and the drive means 17 are arranged outside the magazine 7. This has the advantage that inside the magazine 7 there are neither moving mechanical parts, nor electrical connections that could be damaged over time by the extremely low temperatures, for example −18° C. and lower, that may be required inside the magazine 7 to conserve the frozen products.

Pick-up means 18 are associated with the magazine 7; by means of said pick-up means 18 packages 12 of food products can be picked up inside the magazine 7 and then be sent towards the dispensing opening 4 of the apparatus, or towards heating means that will be described below.

The pick-up means 18 comprise a pair of vertical guides 19 along which a slide 20 can move, said slide 20 being actuated by a motor 21 through belt transmission means 22. The slide 20 is provided with fork means 23 suitable for picking up the packages 12 from the magazine 7 and supporting them to transfer them to said heating means.

The fork means 23 are fixed to a telescopic guide 62 mounted on the slide 20 and are actuated to slide by a telescopic rod 24 moved by a respective motor 25 through wire means 26 or through flexible rack means, for example of the type used to actuate telescopic antennas in motor vehicles.

To pick up a package of food products from the magazine 7, the slide 20, positioned opposite the door 8 of the magazine 7, travels along the guides 19 until it reaches the level of the shelf 15 on which the package to be picked up is arranged, which package has previously been taken to the door 8 by means of rotation of the central column 10. When the slide 20 has reached said level, the telescopic rod 24 is actuated that makes the fork means 23 emerge from the slide. Said fork means 23 penetrate across the space 41 of the door 8, until they reach the package 12 to be picked up, which is then picked up by the fork means 23 and extracted from the magazine 7, thereby causing the fork means to retract into the slide 20. The slide 20 is then lowered to insert the package 12 into heating means 27, constituted by, for example, a microwave oven. The heating means 27 can be arranged, for example, below the magazine 7.

After the package 12 of food products has been heated in the microwave oven 27, it is pushed out of the oven by pusher means 53 associated with the oven 27 and is placed on transfer means 28, that transfer it to the dispensing opening 4, from which the user can pick up the package 12.

The transfer means 28 comprise a support element 29 to which a first end of a first arm 30 and of a second arm 31 are hinged respectively. The second ends of the first arm 30 and of the second arm 31 are hinged to a base 32. The second end of the second arm 31 is connected to a first end of a lever 33, the second end of which is hinged to the piston of an operating cylinder 34. If the operating cylinder 34 is actuated the lever 33 rotates, dragging with it the second arm 31 and causing the support element 29, on which the food product package 12 is located, to travel until said package 12 is brought up to the dispensing opening 4 through which the user can pick up the package 12.

Figure 9:
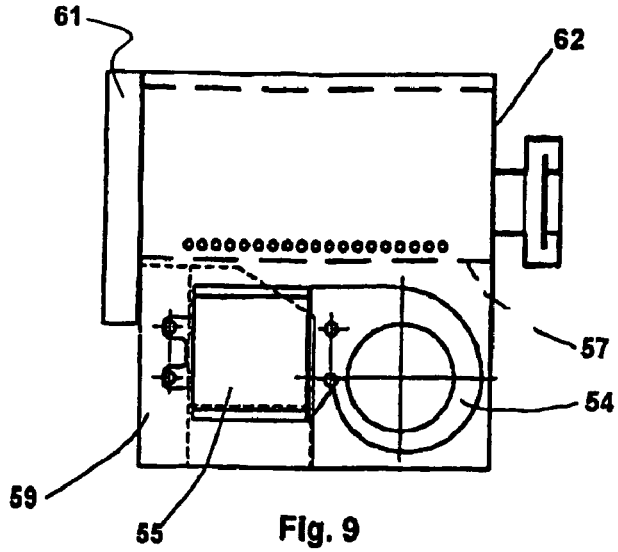
FIG. 9 is a partially sectioned side view of a microwave oven associated with an apparatus according to the invention.
Figure 10:
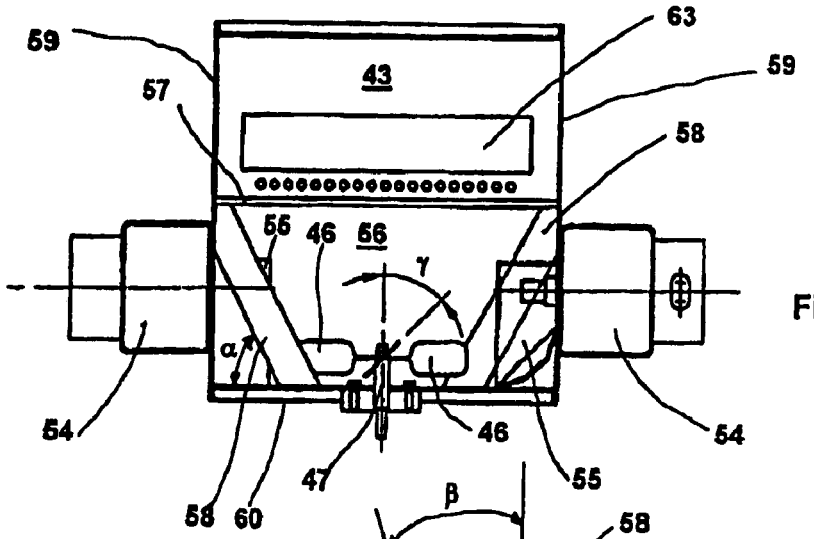
FIG. 10 is the section X—X of FIG. 9.
Figure 11:
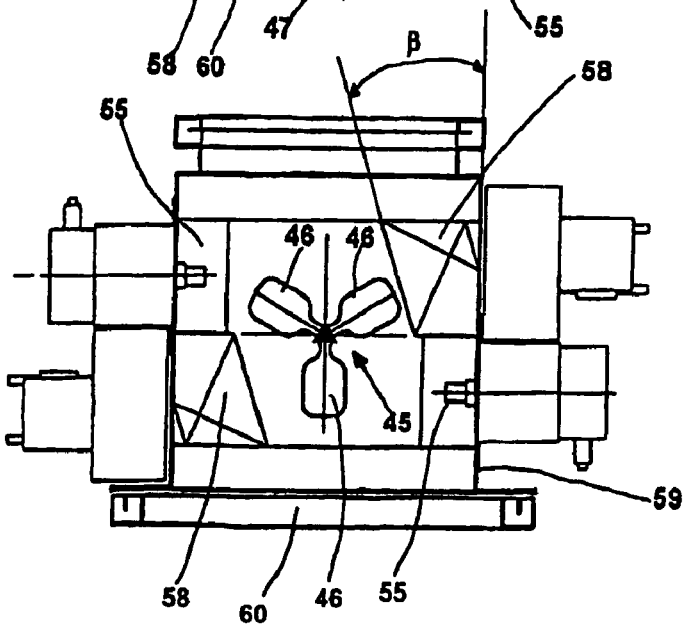
FIG. 11 is the section XI—XI of FIG. 10.
Figure 12:
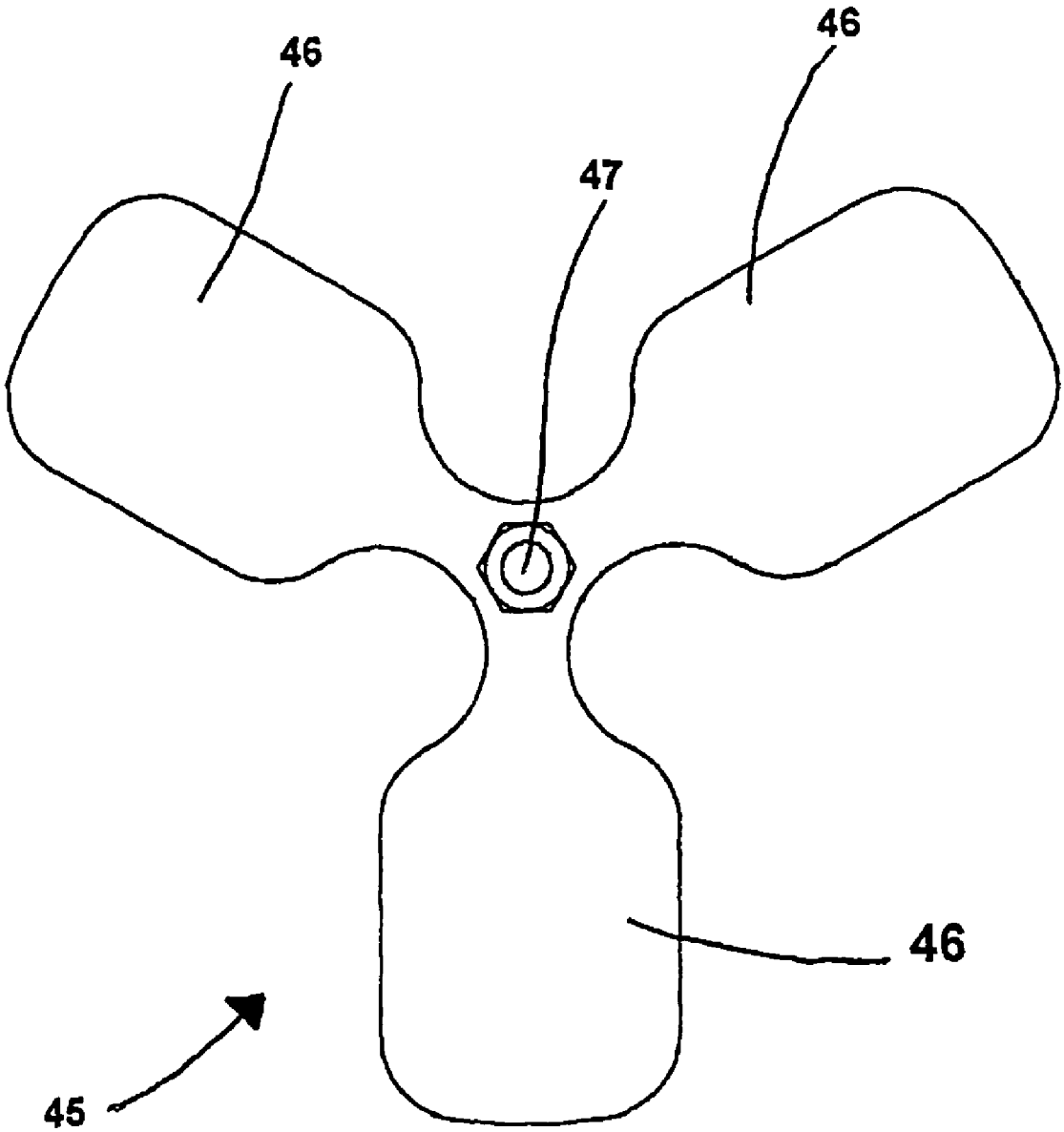
FIG. 12 shows a detail of the microwave oven of FIGS. 9 to 11.

With reference to FIGS. 9 to 11, the heating means 27 may consist of a microwave oven comprising a casing 42, inside which a heating and/or cooking chamber 43 is defined that is designed to receive the packages 12 of food products for heating and/or cooking. A feed chamber 56 is further defined inside the casing 42, the feed chamber 56 being separated from the heating and/or cooking chamber 43 by a wall 57 made of a material that is transparent to microwaves.

Microwave flows produced by proper microwave generators 54 are introduced into the feed chamber 56 by means of respective wave guides 55. The microwaves introduced into the feed chamber 56 pass into the heating and/or cooking chamber 43 through the wall 57.

In order to optimise the distribution of the microwaves inside the chamber 43, to obtain heating and/or cooking of the products placed in said chamber 43 that is as uniform as possible, it is advantageous for the oven to be provided with two microwave generators 54, with the respective wave guides 55 located at the base of the side walls of the feed chamber 56 in diagonally opposite positions. On each of said side walls, in a position that substantially face the wave guide 55 situated on the opposite wall microwave deflector means 58 are provided. Each one of said microwave deflector means 58 consists of a flat element reflecting the microwaves, said flat element being tilted in relation to the floor 60 of the feed chamber 56 by an angle $\alpha$ comprised between about 40° and about 70°, preferably of about 60° and, in relation to the respective side wall 59, of an angle $\beta$ comprised between about 15° and about 45°, preferably of about 20°. On said floor 60 a rotor 45 is installed, that is rotated by a respective motor, not shown. The rotor 45 consists of a series of elements 46 shaped as blades that extends radially from the axis 47 of the rotor 45. These elements 46 shaped as blades are made of a material that reflects the microwaves and are tilted in relation to a plane that is perpendicular to said axis 47 by an angle $\gamma$ comprised between about 10° and about 70°, preferably of about 45°. When the microwave generators 54 are actuated, the beams of microwaves sent to the chamber 60 by the wave guides 55 are reflected towards the heating and/or cooking chamber 43 by the deflector means 58 and by the blades 46 of the rotor 45, so that the microwaves are distributed inside said chamber 43 in a substantially uniform manner.

Thus, the food product contained in a package 12 placed in said chamber is irradiated in a substantially uniform manner so as to be substantially uniform heated and/or cooked without the risk of local overheating or insufficient local heating.

The oven 27 is provided with a door 61 that can slide from the top to the bottom and vice versa to enable product packages 12 to be placed in the heating and/or cooking chamber 43.

The rear wall 62 of the oven 27, at the heating and/or cooking chamber 43, is provided with an opening 63 through which the pusher 53 can slide. When the oven 27 is operating the pusher 53 seals the opening 63 so as to prevent the dispersion of microwaves outside the oven 27.

The apparatus 1 according to the invention has the further advantage of not requiring preset distribution of the product packages 12 inside the magazine 7, which enables the time required to arrange the products inside the magazine to be noticeably reduced. Furthermore, the apparatus 1 according to the invention enables continuous monitoring of the products contained in the magazine 7, which substantially facilitates the management of the operations of restocking the apparatus to replenish the stocks of products that have run out or which are running out.

For this purpose, reading means are provided on the slide 20 that are suitable for reading identification codes marked on the product packages 12. These reading means can be for example barcode reader means, or reader means for reading data recorded on magnetic tape or on microchips.

The reading means are operationally connected with data-processing means to which the reading means transmit the data read on the product packages 12.

When the magazine 7 is loaded with the product packages 12, the slide 20 is made to slide, from top to bottom and vice versa, opposite the door 8 of the magazine 7, which has been previously placed in the opening position. During a stroke of the slide 20, for example from bottom to top, the reading means read the identification data marked on a pile of packages 12, after which the column 10 is rotated to bring a new pile of products 12 opposite the door 8, the identification data of which products are read by the reading means whilst the slide 20 carries out a stroke from top to bottom and so on, until the reading means have read the identification data of all the product packages 12 and have transmitted such data to the data-processing means.

In the case of optical reading means, the door 8 is advantageously provided with a transparent window for a height corresponding to the maximum height of a pile of packages 12, in order to enable the reading means to read the identification data of said packages without the door 8 having to be opened. Thus, alterations to the temperature conditions inside the magazine 7 are avoided, which alterations, even if small, could affect the correct conservation of the frozen or chilled products.

The data-processing means are operationally connected to the display means 6, consisting of a screen such as the screen of a personal computer on which the data-processing means can display the types and prices of products available in response to pushbutton means 48 by which a user can choose the product to pick up.

When a user wishes to purchase a product package 12, after choosing the product from those available displayed on the display means 6 he first inserts into the prepayment means 5 a sum, in the form of banknotes and/or coins corresponding to the price of the product indicated on the display 6 means or a sum that is greater. The prepayment means 5 identify the banknotes and/or the coins inserted and transmit the relative data to the data-processing means, which calculate the total amount inserted and enable the pushbutton means 48 for the selection of those products the cost of which is the same as or less than the sum inserted.

The user now selects the required product by pressing one of the pushbuttons 48, which sends a signal to the data-processing means, which store, by means of the previously mentioned reading means, the position of each package of each type of product inside the magazine 7. The data-processing means then actuate the rotation of the column 10 until a pile of packages 12 containing at least one package of the product chosen by the user is brought opposite the door 8.

Subsequently, the slide 20, sliding on the guides 19, goes to a height corresponding to the position of the product package 12 to be picked up from the pile of packages 12 brought to the space of the door 8. At this point the data-processing means activate the opening of the door 8 and the fork means 23, which extend inside the magazine 7 until the previously chosen package 12 rests on them and then retract to extract said package from the magazine 7, and then take it to opposite the microwave oven 27 and insert it in the oven.

The data-processing means now command the actuation of the microwave oven for the time required to heat the product contained in the package 12 to a set temperature or until it is cooked. At the end of heating or cooking of the product the slide 20 and the fork means are again actuated to pick up the package 12 from inside the microwave oven and transfer it to the transfer means 28, which take said package to the dispensing opening 4, from which it can be picked up by the user.

The data-processing means are programmed to continuously monitor the product packages inside the magazine 7 to actuate an alert procedure when the number of packages of a given product falls below a preset minimum value and to disable the selection of a product when the latter has run out or has expired, on the basis of an expiry date comprised within said identification data. Furthermore, in the case of frozen products if they are provided with a safety element suitable for indicating, for example through a colour change, incorrect conservation of the product, the reading means read any alteration in the safety element so that the data-processing means can prevent the distribution of that product and activate a message indicating that the product is unsuitable for distribution, to enable it to be removed from the magazine 7.

The alert procedure may consist of displaying a message on the display 6 to indicate that packages of a given product that are running out or which have run out should be restocked or that one or more packages of expired or unfit products should be replaced. The alert procedure may also consist of transmitting, for example over a land or mobile telephone line or over a data transmission network in general, a voice message or a data message to an operator assigned to restock or maintain the apparatus 1. This enables the operations of restocking the products in apparatus 1 to be optimised. The operator may also dialogue with the apparatus 1 via said telephone or data transmission line to read the data on the products and/or reprogram the apparatus 1.

Whenever the apparatus 1 is restocked with new product packages, the procedure of reading the product identification codes previously described is repeated to update the database of the data-processing means containing the identification data on each single package and its position inside the magazine 7 and the information on the display means 6, if. necessary.

The apparatus 1 according to the invention is further provided with further magazine means 64, in which packages 66 of cutlery and/or napkins and/or condiments for the products can be stored that are distributed to the user through a further dispensing opening 65 made in the door 3 of the structure 2. Dispensing said packages 66 is controlled by data-processing means and can be subject to payment by the user.

In the apparatus 1 it is further provided grouping on a panel 67 all the electric and electronic components for supplying and managing the apparatus 1. The panel 67 is mounted in a sliding manner on guides 68 inside the apparatus 1, for example on one side of the magazine means 7. This enables rapid and easy access to said components for repair and/or maintenance operations by simply removing the panel 67 from inside the apparatus 1 by making it run along the guides 68.

This is particularly advantageous when the apparatus 1 is installed near or in contact with other appliances that prevent the inside of the apparatus from being accessed from the side, for example by dismantling one of the side walls of the structure 2.

The apparatus 1 can be provided with extraction means, not shown, suitable for extracting from the microwave oven fumes produced during heating or cooking of the products and evacuating them to the outside of the apparatus 1, for example through filtering means.

The apparatus 1 can also be provided with emergency buffer batteries, not shown, to compensate for any interruptions to the electric power supply. In particular, if the interruption to the electric power supply occurs whilst the slide 20 is picking up a product package 12 from the magazine 7, the buffer battery must enable the slide 20 to leave the magazine and the door 8 to close again to prevent damage to the products contained inside the magazine 7. Or if the electric power supply is interrupted after a product package 12 has been picked up from the magazine 7 but before it has been even partially cooked in the microwave oven 27, the buffer battery must enable the package 12 to be returned to the magazine 7.

In the practical embodiment, the materials, the dimensions and the construction details may be different from those indicated, but technically equivalent thereto, without departing from the legal domain of this invention.

The invention claimed is:

1. Apparatus for distributing packages of frozen or heated food products, comprising:

a magazine for containing said packages, resting means for said packages in said magazine, moving means for moving said packages inside said magazine, and extraction means for extracting said packages from said magazine, said moving means comprising actuating means arranged outside said magazine;

said magazine comprising, on a face thereof, an opening for allowing access inside the magazine and, associated with the opening, a door suitable for closing the opening in a sealing manner;

said door comprising on a face thereof, facing said opening when said door is closed, seal means for ensuring a substantially hermetic closure of said opening; and wherein means for heating said seal means are provided.

2. Apparatus according to claim 1, wherein said extraction means are arranged outside said magazine.

3. Apparatus according to claim 1, further comprising refrigeration means for refrigerating the inside of said magazine.

4. Apparatus according to claim 3, wherein said refrigeration means are arranged outside said magazine.

5. Apparatus according to claim 1, wherein said door is slidable in a direction parallel to said opening.

6. Apparatus according, to claim 1, further comprising means for actuating the door.

7. Apparatus according to claim 6, wherein said actuating means comprise lever means.

8. Apparatus according to claim 7, wherein said lever means comprise a pair of top levers and a pair of bottom levers, one end of each lever of said pair of top levers being hinged to a top edge of said door and a corresponding end of each lever of said pair of bottom levers being hinged to a bottom edge of said door.

9. Apparatus according to claim 8, further comprising a first slide means slidable on a top face of said magazine, a second end of a first lever of said pair of top levers being hinged to said first slide means.

10. Apparatus according to claim 9, further comprising a second slide means slidable on a bottom face of said magazine, a second end of said first lever of said pair of bottom levers being hinged to said second slide means.

11. Apparatus according to claim 10, wherein a second lever of said pair of bottom levers, at an intermediate point thereof, is hinged to said second slide means.

12. Apparatus according to claim 11, wherein a distal end portion of said second lever of said pair of top levers extends beyond said intermediate point and comprises a lever arm.

13. Apparatus according to claim 12, further comprising, on said bottom face of said magazine, eccentric means for engagement with said lever arm.

14. Apparatus according to claim 13, wherein said eccentric means is swivelable about an axis perpendicular to said bottom face of said magazine.

15. Apparatus according to claim 9, wherein a second lever of said pair of top levers, at an intermediate point thereof, is hinged to said first slide means.

16. Apparatus according to claim 15, wherein a distal end portion of said second lever of said pair of top levers extends beyond said intermediate point and comprises a lever arm.

17. Apparatus according to claim 16, further comprising, on said top face of said magazine, eccentric means for engagement with said lever arm.

18. Apparatus according to claim 17, wherein said eccentric means is swivelable about an axis perpendicular to said top face of said magazine.

19. Apparatus according to claim 9, further comprising cylinder means for actuating at least one of said first slide means and said second slide means.

20. Apparatus according to claim 1, wherein said moving means comprise column means having a longitudinal axis and supported for rotation about the longitudinal axis, said column means supporting said resting means.

21. Apparatus according to claim 20, wherein said moving means further comprise actuating means and drive means for rotating said column means about said longitudinal axis.

22. Apparatus according to claim 20, wherein said resting means comprise annular shelves fixed in preset positions to said column means.

23. Apparatus according to claim 20, wherein said resting means comprise shelf means having ends coupled with said column means.

24. Apparatus according to claim 23, wherein said shelf means have the shape of an annular sector.

25. Apparatus according to claim 23, further comprising slits in said column means, said slits effecting said coupling of said ends of said shelf means with said columns means.

26. Apparatus according to claim 1, wherein said extraction means comprise pairs of vertical guides and slide means movable in a vertical direction along said pairs of vertical guides.

27. Apparatus according to claim 26, wherein said extraction means further comprises motor means and transmission means, said movement of said slide means along said vertical guides being actuatable by said motor means through said transmission means.

28. Apparatus according to claim 26, wherein said slide means comprise fork means movable in a direction perpendicular to said door.

29. Apparatus according to claim 28, wherein said fork means are adapted to be coupled with said packages of said products.

30. Apparatus according to claim 28, further comprising telescopic rod means extendable in said direction, said fork means being connected to said telescopic rod means.

31. Apparatus according to claim 30, further comprising additional motor means and wire transmission or flexible rack transmission means, said telescopic rod means being actuatable by said additional motor means through said wire transmission or flexible rack transmission means.

32. Apparatus according to claim 28, further comprising a telescopic guide fitted to said slide means, said fork means being fixed to said telescopic guide.

33. Apparatus according to claim 26, further comprising reading means associated with said slide means for reading identification codes marked on said product packages.

34. Apparatus according to claim 33, wherein said reading means comprise optical reading means.

35. Apparatus according to claim 33, wherein said reading means comprise magnetic reading means.

36. Apparatus according to claim 33, wherein said reading means comprise remote reading means for reading microchip means that can be associated with said product packages.

37. Apparatus according to claim 1, further comprising:
buffer battery means for connection to an electric power supply of the apparatus.

* * * * *